US009010417B2

(12) United States Patent
Garcia et al.

(10) Patent No.: US 9,010,417 B2
(45) Date of Patent: Apr. 21, 2015

(54) DOWNHOLE SCREEN WITH EXTERIOR BYPASS TUBES AND FLUID INTERCONNECTIONS AT TUBULAR JOINTS THEREFORE

(75) Inventors: Luis A. Garcia, Kingwood, TX (US); Britain A. Fisher, Houston, TX (US); Elmer R. Peterson, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 599 days.

(21) Appl. No.: 13/370,038

(22) Filed: Feb. 9, 2012

(65) Prior Publication Data

US 2013/0206394 A1 Aug. 15, 2013

(51) Int. Cl.
*E21B 43/08* (2006.01)
*E21B 43/04* (2006.01)

(52) U.S. Cl.
CPC *E21B 43/08* (2013.01); *E21B 43/04* (2013.01)

(58) Field of Classification Search
CPC ..... E21B 43/04; E21B 43/045; E21B 43/08
USPC ..... 166/227, 235, 205, 236, 51, 242.6, 278
See application file for complete search history.

(56) References Cited

U.S. PATENT DOCUMENTS

| | | | | |
|---|---|---|---|---|
| 315,815 | A | | 4/1885 | Morris |
| 1,341,755 | A | | 6/1920 | Minton |
| 4,064,938 | A | | 12/1977 | Fast |
| 4,508,135 | A | | 4/1985 | Schlesch et al. |
| 4,510,996 | A | | 4/1985 | Hardin |
| 5,082,052 | A | | 1/1992 | Jones |
| 5,113,935 | A | * | 5/1992 | Jones et al. ..... 166/51 |
| 5,355,949 | A | | 10/1994 | Sparlin et al. |
| 5,390,966 | A | | 2/1995 | Cox et al. |
| 5,476,143 | A | | 12/1995 | Sparlin et al. |
| 5,515,915 | A | * | 5/1996 | Jones et al. ..... 166/51 |
| 5,609,204 | A | | 3/1997 | Rebardi et al. |
| 5,624,560 | A | | 4/1997 | Voll et al. |
| 5,787,980 | A | | 8/1998 | Sparlin et al. |
| 5,842,516 | A | * | 12/1998 | Jones ..... 166/56 |
| 5,865,251 | A | | 2/1999 | Rebardi et al. |
| 5,868,200 | A | * | 2/1999 | Bryant et al. ..... 166/51 |
| 5,921,318 | A | | 7/1999 | Ross |
| 5,934,376 | A | | 8/1999 | Nguyen et al. |
| 6,003,600 | A | | 12/1999 | Nguyen et al. |
| 6,140,277 | A | | 10/2000 | Tibbles et al. |
| 6,170,522 | B1 | | 1/2001 | Tanida |
| 6,192,924 | B1 | | 2/2001 | McNeely et al. |
| 6,196,596 | B1 | | 3/2001 | Kwok et al. |
| 6,298,916 | B1 | * | 10/2001 | Tibbles et al. ..... 166/278 |

(Continued)

*Primary Examiner* — Shane Bomar
*Assistant Examiner* — Christopher Sebesta
(74) *Attorney, Agent, or Firm* — Steve Rosenblatt

(57) ABSTRACT

An assembly of screens made of connected joints with exterior bypasses that span the threaded connections among the joints features common fluid connections for the bypasses adjacent joint threaded ends that are connected with a coupling. A mandrel spans from one joint to the next inside the threaded coupling and is sealed to the respective bases pipes on opposed ends of the coupling. At each end of the mandrel the surrounding base pipe has openings from the common fluid connection where the bypasses terminate to define an annular flow path between pairs of common fluid connections. The bypasses can have slanted gravel outlet passages or no gravel openings at all. The bypasses can span over screen or blank pipe with an option to mount a shroud over the generally parallel bypasses.

20 Claims, 6 Drawing Sheets

(56) References Cited

U.S. PATENT DOCUMENTS

| | | | | |
|---|---|---|---|---|
| 6,343,651 | B1 | 2/2002 | Bixxenman | |
| 6,405,800 | B1 | 6/2002 | Walker et al. | |
| 6,409,219 | B1 | 6/2002 | Broome et al. | |
| 6,427,775 | B1 | 8/2002 | Dusterhoft et al. | |
| 6,446,722 | B2 | 9/2002 | Nguyen et al. | |
| 6,464,006 | B2 | 10/2002 | Womble | |
| 6,481,494 | B1 | 11/2002 | Dusterhoft et al. | |
| 6,520,254 | B2 | 2/2003 | Hurst et al. | |
| 6,540,022 | B2 | 4/2003 | Dusterhoft et al. | |
| 6,569,814 | B1 | 5/2003 | Brady et al. | |
| 6,571,872 | B2 | 6/2003 | Dusterhoft et al. | |
| 6,575,251 | B2 | 6/2003 | Watson et al. | |
| 6,588,506 | B2 | 7/2003 | Jones | |
| 6,631,764 | B2 | 10/2003 | Parlar et al. | |
| 6,638,896 | B1 | 10/2003 | Tibbles et al. | |
| 6,681,854 | B2 | 1/2004 | Danos | |
| 6,719,064 | B2 | 4/2004 | Price-Smith et al. | |
| 6,749,023 | B2 | 6/2004 | Nguyen et al. | |
| 6,749,024 | B2 | 6/2004 | Bixxeman | |
| 6,752,207 | B2 | 6/2004 | Danos et al. | |
| 6,789,621 | B2 | 9/2004 | Wetzel et al. | |
| 6,817,410 | B2 | 11/2004 | Wetzel et al. | |
| 6,830,504 | B1 | 12/2004 | Chen et al. | |
| 6,848,510 | B2 | 2/2005 | Bixenman et al. | |
| 6,883,608 | B2 | 4/2005 | Parlar et al. | |
| 6,923,262 | B2 | 8/2005 | Broome et al. | |
| 7,048,061 | B2 | 5/2006 | Bode et al. | |
| 7,063,738 | B2 | 6/2006 | Danican et al. | |
| 7,104,324 | B2 | 9/2006 | Wetzel et al. | |
| 7,131,494 | B2 | 11/2006 | Bixenman et al. | |
| 7,147,003 | B2 | 12/2006 | Maldavs | |
| 7,147,054 | B2 | 12/2006 | Wang et al. | |
| 7,152,677 | B2 | 12/2006 | Parlar et al. | |
| 7,182,134 | B2 | 2/2007 | Wetzel et al. | |
| 7,207,383 | B2 | 4/2007 | Hurst et al. | |
| 7,222,676 | B2 | 5/2007 | Patel et al. | |
| 7,363,974 | B2 | 4/2008 | Wang et al. | |
| 7,370,700 | B2 | 5/2008 | Hurst et al. | |
| 7,373,989 | B2 | 5/2008 | Setterberg, Jr. | |
| 7,407,007 | B2 | 8/2008 | Tibbles | |
| 7,419,004 | B2 | 9/2008 | Salamat | |
| 7,451,816 | B2 | 11/2008 | Corbett et al. | |
| 7,464,752 | B2 | 12/2008 | Dale et al. | |
| 7,475,725 | B2 | 1/2009 | Yeh et al. | |
| 7,493,959 | B2 | 2/2009 | Johnson et al. | |
| 7,497,267 | B2 | 3/2009 | Setterberg, Jr. et al. | |
| 7,510,011 | B2 | 3/2009 | Le Gloahec et al. | |
| 7,520,326 | B1 | 4/2009 | Hill et al. | |
| 7,562,709 | B2 | 7/2009 | Saebi et al. | |
| 7,591,321 | B2 | 9/2009 | Whitsitt et al. | |
| 7,597,141 | B2 | 10/2009 | Rouse et al. | |
| 2002/0174984 | A1* | 11/2002 | Jones | 166/278 |
| 2002/0189809 | A1* | 12/2002 | Nguyen et al. | 166/278 |
| 2003/0000699 | A1* | 1/2003 | Hailey, Jr. | 166/278 |
| 2004/0262011 | A1 | 12/2004 | Huckabee et al. | |
| 2005/0200127 | A1 | 9/2005 | Johnson et al. | |
| 2007/0084608 | A1 | 4/2007 | Bixenman et al. | |
| 2007/0102153 | A1 | 5/2007 | Bixenman et al. | |
| 2007/0119598 | A1 | 5/2007 | Turner et al. | |
| 2007/0227727 | A1 | 10/2007 | Patel et al. | |
| 2007/0235185 | A1 | 10/2007 | Patel et al. | |
| 2007/0246212 | A1 | 10/2007 | Richards | |
| 2008/0029273 | A1 | 2/2008 | Pia | |
| 2008/0314588 | A1 | 12/2008 | Langlais et al. | |
| 2008/0314589 | A1 | 12/2008 | Guignard et al. | |
| 2009/0008084 | A1 | 1/2009 | Dybevik et al. | |
| 2009/0008092 | A1 | 1/2009 | Haeberle et al. | |
| 2009/0025923 | A1 | 1/2009 | Patel et al. | |
| 2009/0066535 | A1 | 3/2009 | Patel et al. | |
| 2009/0095471 | A1 | 4/2009 | Guignard et al. | |
| 2009/0133874 | A1 | 5/2009 | Dale et al. | |
| 2009/0133875 | A1 | 5/2009 | Tibbles et al. | |
| 2009/0159270 | A1 | 6/2009 | Setterberg, Jr. et al. | |
| 2009/0166045 | A1 | 7/2009 | Wetzel et al. | |
| 2009/0229823 | A1 | 9/2009 | Moen et al. | |
| 2009/0235185 | A1 | 9/2009 | Gill | |
| 2009/0283279 | A1 | 11/2009 | Patel et al. | |
| 2009/0294128 | A1 | 12/2009 | Dale et al. | |
| 2010/0059223 | A1* | 3/2010 | Langlais et al. | 166/276 |
| 2010/0155064 | A1* | 6/2010 | Nutley et al. | 166/278 |

* cited by examiner

DOWNHOLE SCREEN WITH EXTERIOR BYPASS TUBES AND FLUID INTERCONNECTIONS AT TUBULAR JOINTS THEREFORE

FIELD OF THE INVENTION

The field of this invention is screen assemblies for subterranean use made from a plurality of sections that are threaded together. Bypass tubes extend exterior to the screens to a coupling assembly that uses an internal mandrel spanning the coupling connection for internally fluidly connecting the bypasses in an annular path. At least one of the bypasses on any joint can have sloping outlets with adjacent standoffs.

BACKGROUND OF THE INVENTION

Screen assemblies are frequently used in completions in association with gravel packed around the screen sections in the annular space that surrounds the screens. Getting a good distribution of gravel is important for the effectiveness of the gravel pack as an aide in trapping particulates in the produced fluids and thus extending the service life of the screens. Getting the gravel to distribute evenly particularly in horizontal completions has always been an issue. Another issue is the tendency of the gravel to bridge so that gaps over the screens are formed where there is no packed gravel. Apart from the operational issues there are issues with ease of assembly of the joints of screen and connecting the bypasses that go through the screens or outside of the screens.

One design that connects the annular spaces between screen and base pipe of adjacent screen sections is shown in U.S. Pat. No. 6,405,800 where a passage from the adjacent annular spaces under adjacent screens goes through an annular passage in a coupling using an internal mandrel that spans the joint with openings at opposed ends to connect the adjacent annular spaces between adjacent screens. Other examples of flow through connectors used with screens are U.S. Pat. Nos. 7,048,061; 6,170, 522; 6,192,924; 6,196,596; 4,508,135; 7,147,003; 6,409,219; 5,082,052; 6,752,207; 5,868,200; 5,476,143; 4,510,996; 6,923,262 and US Publication 2009/0095471.

These designs had various limitations in the areas of ease of assembly, durability or in the limited configurations they made possible. They connected bypasses individually across a joint; they had a clamshell design that had to be bolted across a joint; they provided a limited number of bypass orientations before the pattern repeated or they simply connected annular spaces under adjacent screen sections. The present invention addresses these issues in a way that those skilled in the art will appreciate that allows rapid fluid connection of bypasses across a threaded connection as well as multiple patterns of a bypass with gravel outlets in combination with bypasses that have no outlets so as to orient the gravel outlet bypass on a given joint in multiple circumferential orientations without using complex structures such as timed threads or floating bypass tube assemblies, which are free to rotate during make up on the rig floor. These and other aspects of the present invention will be more readily apparent to those skilled in the art from a review of the discussion of the preferred embodiment and the associated drawings while appreciating that the full scope of the invention is to be found in the appended claims.

SUMMARY OF THE INVENTION

An assembly of screens made of connected joints with exterior bypasses that span the threaded connections among the joints features common fluid connections for the bypasses adjacent joint threaded ends that are connected with a coupling. A mandrel spans from one joint to the next inside the threaded coupling and is sealed to the respective bases pipes on opposed ends of the coupling. At each end of the mandrel the surrounding base pipe has openings from the common fluid connection where the bypasses terminate to define an annular flow path between pairs of common fluid connections. The bypasses can have slanted gravel outlet passages or no gravel openings at all. The bypasses can span over screen or blank pipe with an option to mount a shroud over the generally parallel bypasses.

DETAILED DESCRIPTION OF THE PREFERRED EMBODIMENT

Figure 1:
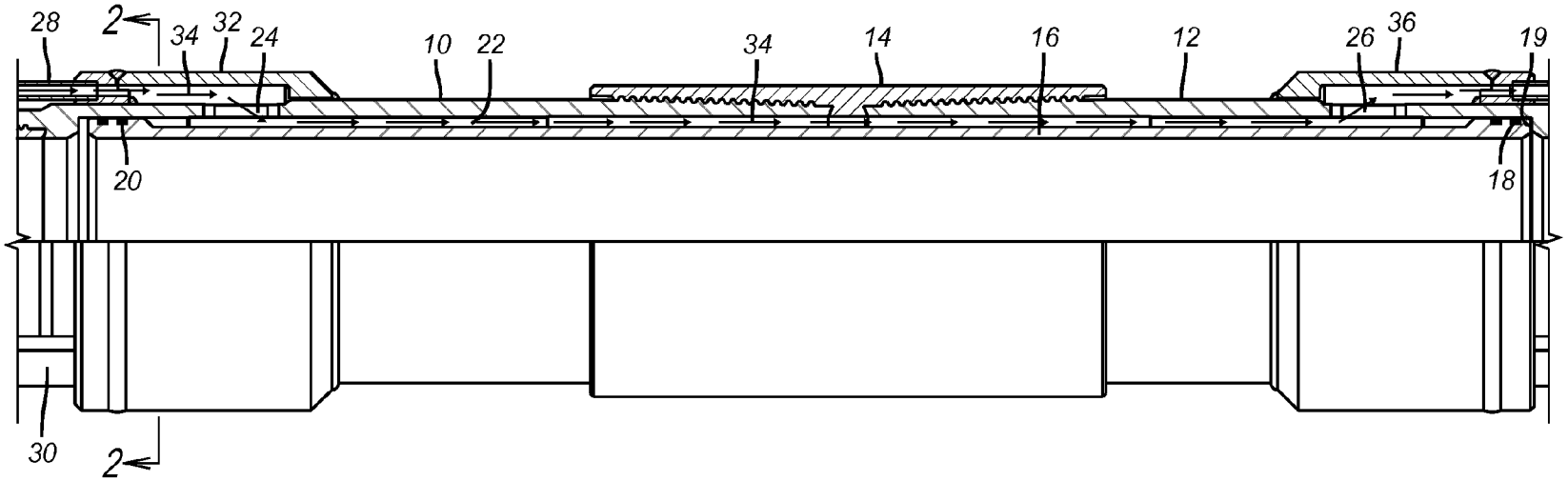
FIG. 1 is a section view of a connected joint showing the annular passage through the coupling for the bypasses.

Referring to FIG. 1 base pipes 10 and 12 are connected with a threaded coupling 14. Before base pipe 10 is positioned next to coupling 14 for threading, a mandrel 16 is inserted into the base pipe 12 and is shouldered on shoulder 19. One or more seals 18 seal against base pipe 12. As base pipe 10 is threaded to coupling 14 upper seals 20 are in sealing engagement with base pipe 10. When base pipe 10 is fully made up to the coupling 14 an annular passage 22 is defined between the mandrel 16 and the connected base pipes 10 and 12 that are now threadedly secured with coupling 14. The passage has inlets 24 in base pipe 10 and outlets 26 in base pipe 12. A plurality of bypass tubes, two of which 28 and 30, are shown terminating in a common end ring or common fluid connection 32 with preferably a sealed connection that can be accomplished by welding, seals or other devices. Optionally, some minimal clearance can be used with some minor leakage tolerated. Flow exiting tubes 28 and 30 is represented by arrows 34 passes through the openings 24 on the way to the annular passage 22 before making an exit through openings 26 that lead to end ring or common fluid connection 36 on base pipe 12. In essence the assembly at opposed ends of FIG. 1 is a mirror image.

Figure 2:
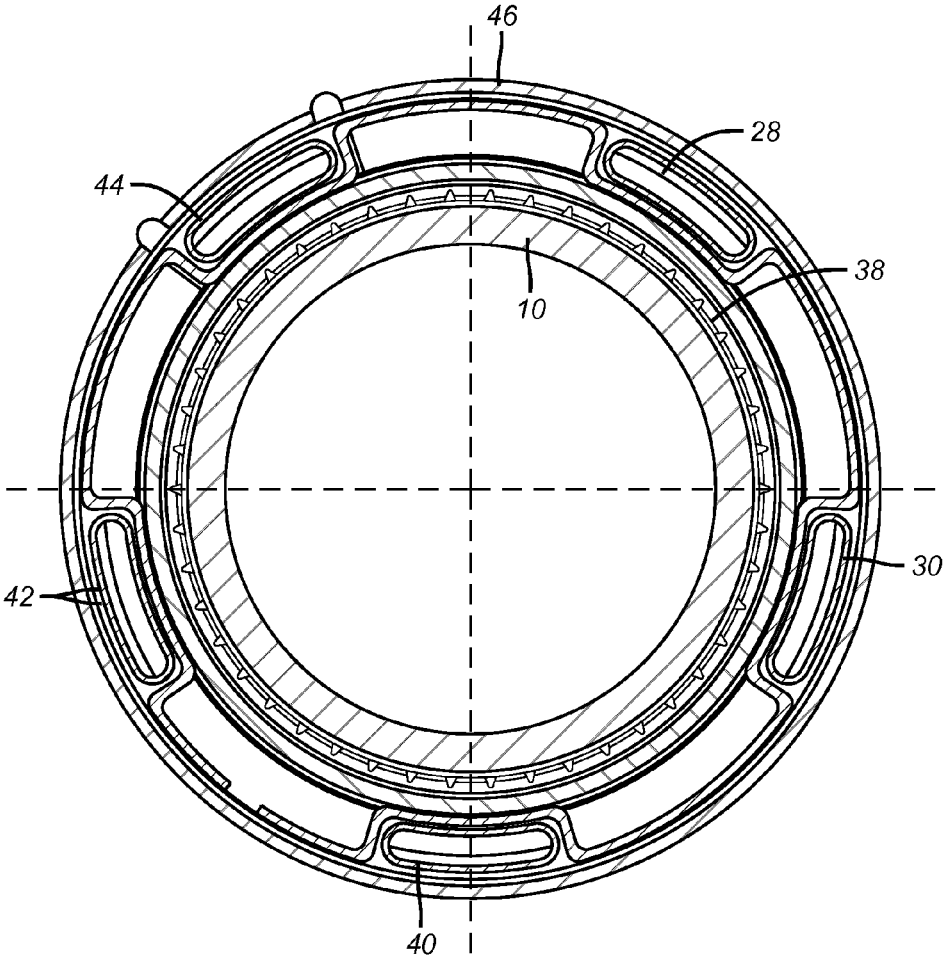
FIG. 2 is the view along line 2-2 of FIG. 1.
Figure 7:
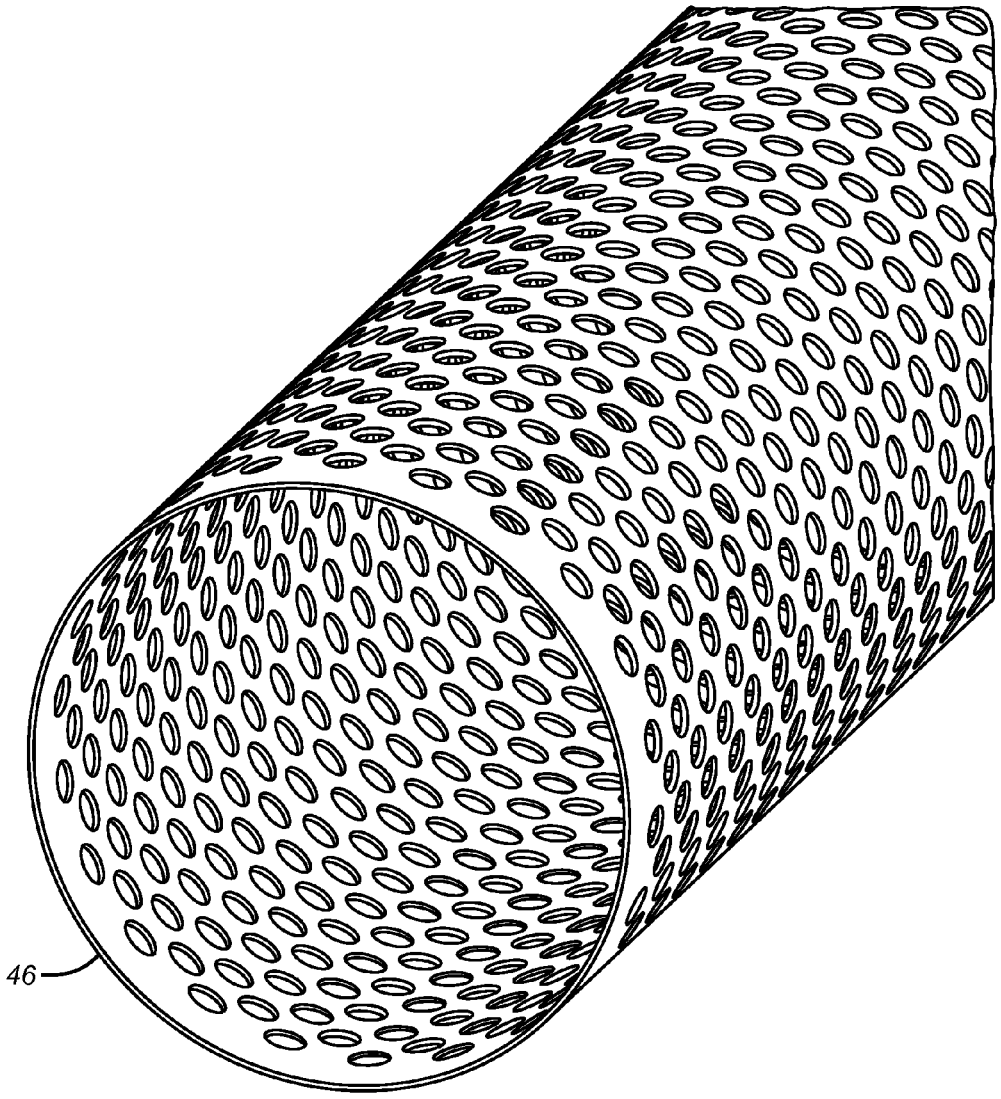
FIG. 7 is a perspective view of a protective shroud that can be mounted over the bypasses.

Off to the left end of FIG. 1 and on base pipe 10 is a screen 38 which is best seen in FIG. 2. The screen can be a variety of known designs such as wire wrap with the base pipe 10 having openings below the screen 38 in a known manner. Off to the right end of FIG. 1 is a mirror image assembly with another screen over base pipe 12 and mounted in the same manner. Also shown in FIG. 2 is a preferred layout using s bypasses 28, 30, 40, 42 and 44. Those skilled in the art will appreciate that the number of bypasses depends on their size and shape and the size of the underlying screen and base pipe combination. Preferably the height of the bypasses should be at a minimum to reduce the drift dimension of the optional shroud 46 shown in FIGS. 2 and 7. The shroud 46 is a design well known in the art and is for the most part a perforated sleeve with a repeating pattern of openings that can be manufactured in a variety of ways. Preferably, the shroud 46, if used extends over the length of a screen 38 on a given joint of base pipe such as 10 or 12 where the screen 38 stops short of the common fluid connections such as 32 and 26 that appear on most of the joints in the screened interval. Those skilled in the art will appreciate that the bypasses can span over blank pipe joints as well as screened joints.

Referring to FIGS. 2 and 4-6 it will be seen that the preferred arrangement on any joint with a screen is to have a single bypass such as 44 that has outlet ports 48 and 50 and a lower open end 52. The outlets 48 and 50 have openings with an outlet sloping face 54 to minimize the erosion effects of gravel that flows through. There are opposed parallel standoffs 56 and 58 to promote gravel exit flow by raising the opening from the surrounding wellbore wall.

Figure 3:
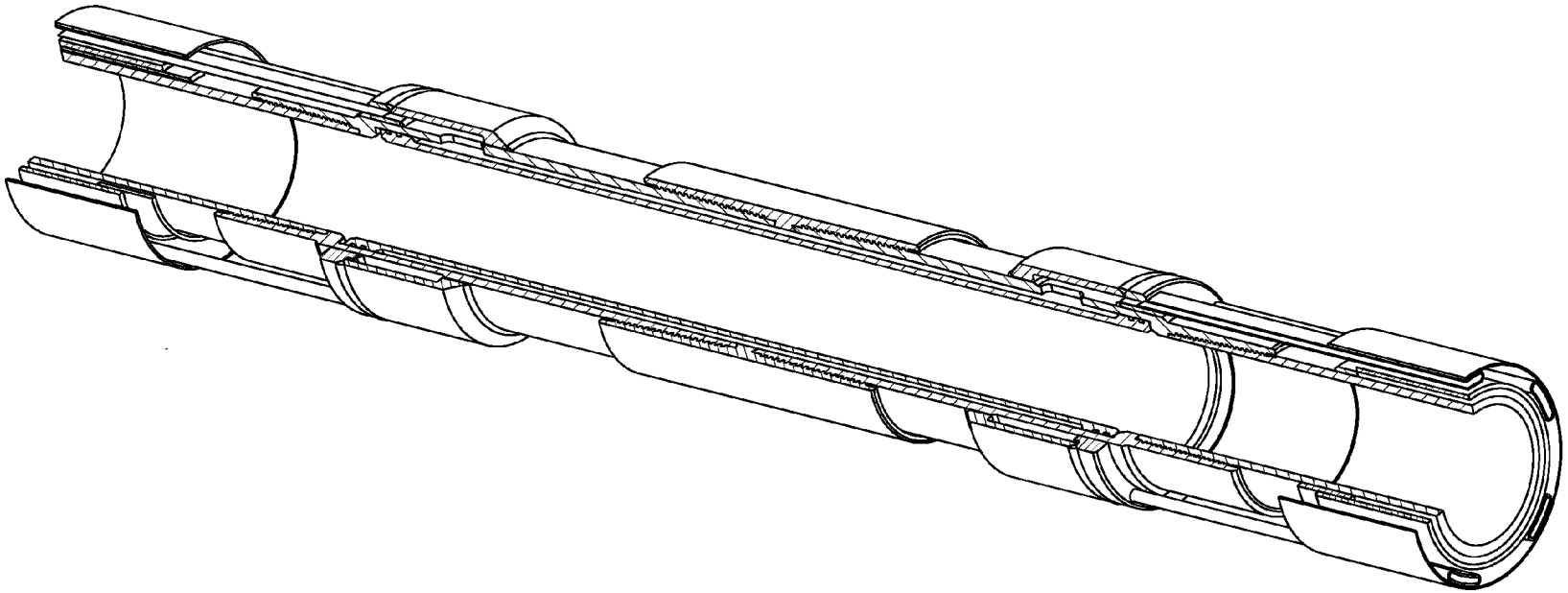
FIG. 3 is a perspective view of FIG. 1.
Figure 4:
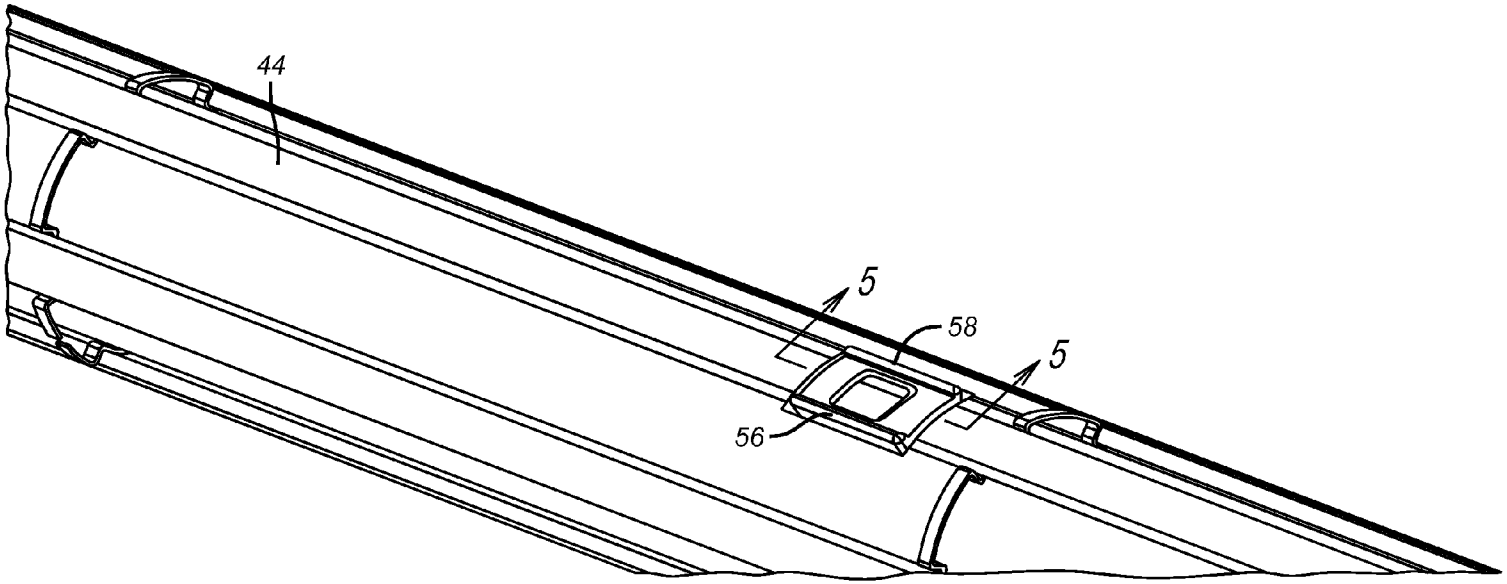
FIG. 4 is a perspective view of a bypass outlet showing the opposed standoffs.
Figure 5:
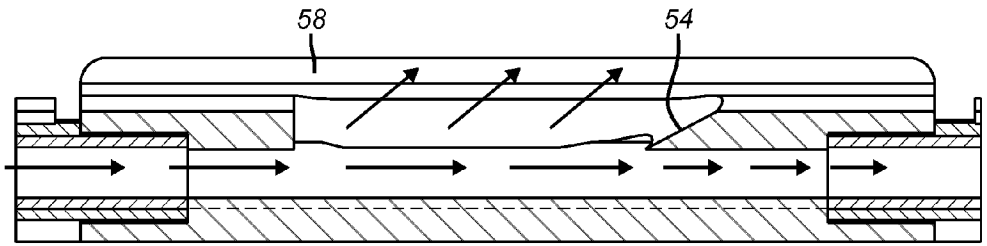
FIG. 5 is a section view taken along line 5-5 of FIG. 4 through a bypass outlet.
Figure 6:
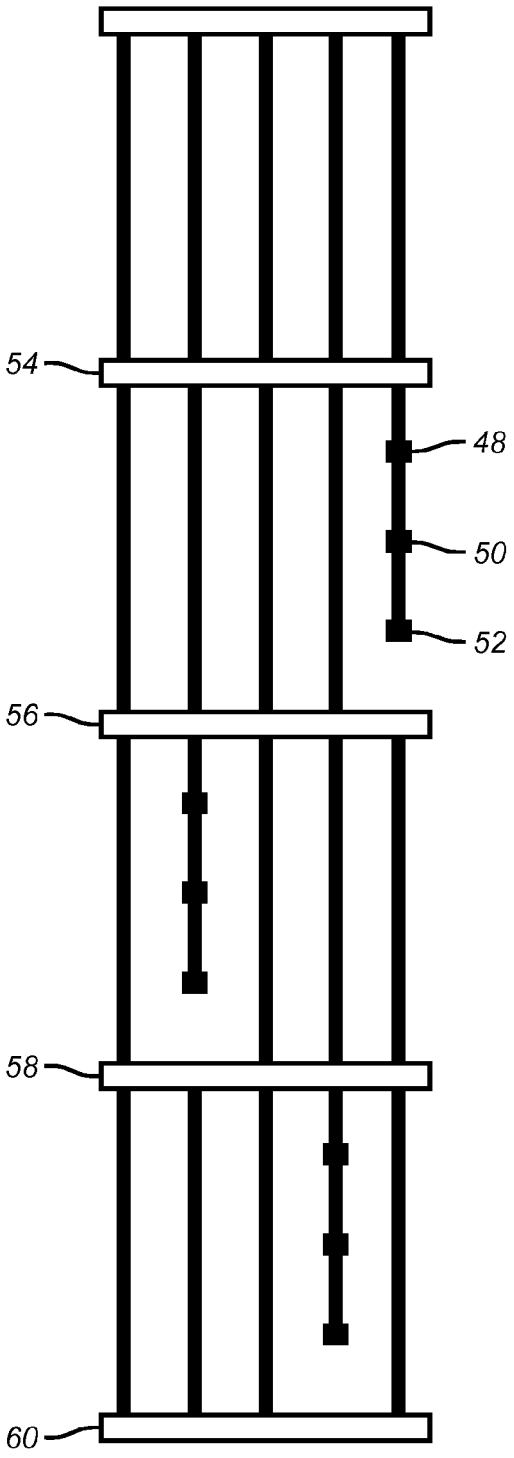
FIG. 6 illustrates a possible orientation of perforated and unperforated bypasses.

FIG. 6 shows a preferred arrangement along a string of joints that have screens with overlaying bypasses between common fluid connections 54, 56, 58 and 60. In each interval between common fluid connections there are multiple bypasses with no openings and one shown with three openings 48, 50 and 52. The circumferential positioning of the bypass with openings is preferably varied so that the bypasses with openings between adjacent common fluid connections are circumferentially offset in a pattern that repeats and is evenly spaced or on the other hand is totally random. While a single bypass is shown with openings in between adjacent common fluid connections more than one bypass can have openings between a pair of common fluid connections. While the bypasses without openings are shown aligned in FIG. 6 between common fluid connections they can also be offset in a regular or a random pattern. The illustrated common fluid connections conform to the earlier provided description in conjunction with FIGS. 1-3.

What is illustrated is a system that is assembled quickly that can connect bypasses across a coupling through a passage that is annular and extends within the coupling so that the bypasses are commonly fluidically connected together on opposed ends of the threaded connection. An inserted mandrel with end seals against base pipes on opposed ends of the coupling and ports on the base pipes on opposed sides of the coupling define each annular flow path. Bypasses without openings can be used to connect the spaced apart common fluid connections and the bypasses can also be used to span sections of blank pipe. While the bypasses are preferably outside the screen sections where the screen is sealed on opposed ends to the outside of the blank pipe, other arrangements are contemplated such as running some or all the shunts under the screen and cutting out parts of the screen for gravel outlets from the bypasses. Alternatively some bypasses can be over the screen with exit ports while others can be under the screen. While the bypasses are shown as extending generally axially they can also be spirally oriented on the base pipes.

We claim:

1. A completion assembly for subterranean use, comprising:

at least a first and a second tubulars selectively connected with at least one coupling;

at least one bypass tube on an outer surface of said first tubular that has ends terminating in at least one first common fluid connection that defines a first annularly shaped path with said first tubular;

at least one bypass tube on an outer surface of said second tubular that has ends terminating in at least one second common fluid connection that defines a second annularly shaped path with said second tubular;

said first tubular having at least one wall port within said first common fluid connection;

said second tubular having at least one wall port within said second common fluid connection;

a mandrel mounted within said coupling and defining an annularly shaped flowpath therebetween that puts said first and second annularly shaped paths in fluid communication through said wall ports.

2. The assembly of claim 1, wherein:

said first and second tubulars further comprise a screen having sealed ends with said first and second tubulars respectively that stop short of said common fluid connection thereon;

said bypass tube on each said tubulars positioned on an outer surface of a screen mounted thereon.

3. The assembly of claim 1, wherein:

said at least one bypass tube on said first and second tubulars comprises a plurality of circumferentially spaced bypass tubes with at least one said bypass on each of said first and second tubulars having at least one lateral opening.

4. The assembly of claim 3, wherein:

said bypass tube with said opening has an open end that stops short of an adjacent common fluid connection and at least one other opening along the length of said bypass tube.

5. The assembly of claim 4, wherein:

said opening along the length of said bypass tube has a sloping lower end.

6. The assembly of claim 4, wherein:

said opening along the length of said bypass tube has opposed standoffs to help maintain flow through said opening.

7. The assembly of claim 3, wherein:

all but one of said bypasses on said first and second tubulars have no lateral openings between ends that terminate in said common fluid connections.

8. The assembly of claim 7, wherein:

said bypasses on said first tubular are aligned with bypasses on said second tubular.

9. The assembly of claim 7, wherein:

said bypasses on said first tubular are misaligned with bypasses on said second tubular.

10. The assembly of claim 3, wherein:

said bypasses with said lateral opening on said first and second tubulars are misaligned.

11. The assembly of claim 3, further comprising:

a perforated shroud mounted over said bypass tubes on said first and second tubulars.

12. A completion assembly for subterranean use, comprising:

at least two screened base pipe joints connected with at least one threaded coupling;

a mandrel inside said coupling and defining an annularly shaped passage therebetween extending within said screened base pipe joints and said coupling;

at least one bypass tube over each of said screened base pipes, said bypass tube on each said base pipe having at least one enclosed end in fluid communication with at least one wall opening in said joint leading into said annularly shaped passage.

13. The assembly of claim 12, wherein:

said wall opening in each joint is axially offset from said screen on the same joint.

14. The assembly of claim 12, wherein:

said mandrel has an external recess that defines said annularly shaped passage.

15. The assembly of claim 14, wherein:

said mandrel has external end seals outside said recess that respectively internally engage said screened base pipe joints.

16. The assembly of claim 12, wherein:

said at least one bypass on said screened base pipe joints comprises a plurality of bypasses that have opposed ends in a common fluid connection sealed to said screened base pipe joints over said wall openings.

17. The assembly of claim 16, wherein:

at least one bypass on each screened base pipe joint has at least one lateral opening, said lateral opening having a sloping lower end and said bypass with said lateral opening further comprising an open lower end.

18. The assembly of claim 16, wherein:

said bypasses with said lateral opening are circumferentially offset as between said screened base pipe joints.

19. The assembly of claim 16, wherein:

a plurality of said bypasses on each said screened base pipe joint have no lateral openings and are aligned on adjacent screened base pipe joints.

20. The assembly of claim 16, wherein:

said bypasses are covered on each said screened base pipe joint with a perforated shroud.

* * * * *